United States Patent [19]

Röck et al.

[11] Patent Number: 4,911,509

[45] Date of Patent: Mar. 27, 1990

[54] APPARATUS FOR TEMPORARILY INCREASING THE HEIGHT OF A DRAWER SIDE WALL

[75] Inventors: Erich Röck, Höchst; Helmut Hollenstein, Lustenau, both of Austria

[73] Assignee: Julius Blum Gesellschaft m.b.H., Höchst, Austria

[21] Appl. No.: 272,249

[22] Filed: Nov. 17, 1988

[30] Foreign Application Priority Data

Dec. 23, 1987 [AT] Austria ..... 3405/87

[51] Int. Cl.[4] ..... A47B 88/00

[52] U.S. Cl. ..... 312/348.1

[58] Field of Search ..... 312/330 R, 183, 184, 312/348.1

[56] References Cited

U.S. PATENT DOCUMENTS

| | | | |
|---|---|---|---|
| 3,456,994 | 7/1989 | Sullivan | 312/184 |
| 4,112,539 | 9/1978 | Hagen | 312/341.1 |
| 4,726,635 | 2/1988 | Rariden et al. | 312/184 |
| 4,804,239 | 2/1989 | Rock et al. | 312/330 RX |

*Primary Examiner*—Joseph Falk

*Attorney, Agent, or Firm*—Wenderoth, Lind & Ponack

[57] ABSTRACT

A drawer includes metal drawer side walls, with a rail member arranged above each drawer side wall. A lateral top member is clamped onto each rail member and abuts on the upper rim of the inner side of the drawer side wall.

10 Claims, 5 Drawing Sheets

APPARATUS FOR TEMPORARILY INCREASING THE HEIGHT OF A DRAWER SIDE WALL

FIELD AND BACKGROUND OF THE INVENTION

The invention relates to a drawer having preferably metal drawer side walls, with a rail member being arranged above each drawer side wall.

Lately, an increasing number of drawers with metal side walls or with side walls of injection moulded plastics material have been put on the market. Drawer side walls of this kind allow quick assembling of the drawer, and metal drawer side walls improve the loading capacity of the drawer.

Moreover, drawers are known in which one rail member is arranged above each of the drawer side walls and extends from the front plate to the rear wall of the drawer. It has been found more advantageous in some cases to have a drawer with higher side walls instead of one with rail members. According to the known state of the art, this requirement necessitated drawer side walls of different heights. Furthermore, it was impossible to change a drawer with high side walls and without rail members into a drawer with low side walls and with rail members.

SUMMARY OF THE INVENTION

It is the object of the invention to improve a drawer by providing side walls and with a rail member on each side in that the drawer can be used for many purposes.

According to the invention this is achieved by a lateral top member attachable to each rail member, e.g. clampable thereto or hangable thereon.

It is advantageously provided that the top member abuts on the internal side of the upper rim of the drawer side wall.

Objects which are in the drawer and push against the top members will not loosen the top members from the rail members.

An embodiment of the invention provides that the top members have two horizontal flanges, the edges of which are bent towards each other, and the rail member is received and clamped between such flanges.

A further embodiment provides that the top member has an upwardly bent flange.

Separating elements for the drawer but also conventional suspendable files or the like can engage the upwardly extending flanges also can be used for the fixation of tabs or signals.

BRIEF DESCRIPTION OF THE DRAWINGS

In the following embodiments of the invention will be described in more detail with reference to the accompanying drawings in which.

DESCRIPTION OF THE PREFERRED EMBODIMENTS

Figure 1:
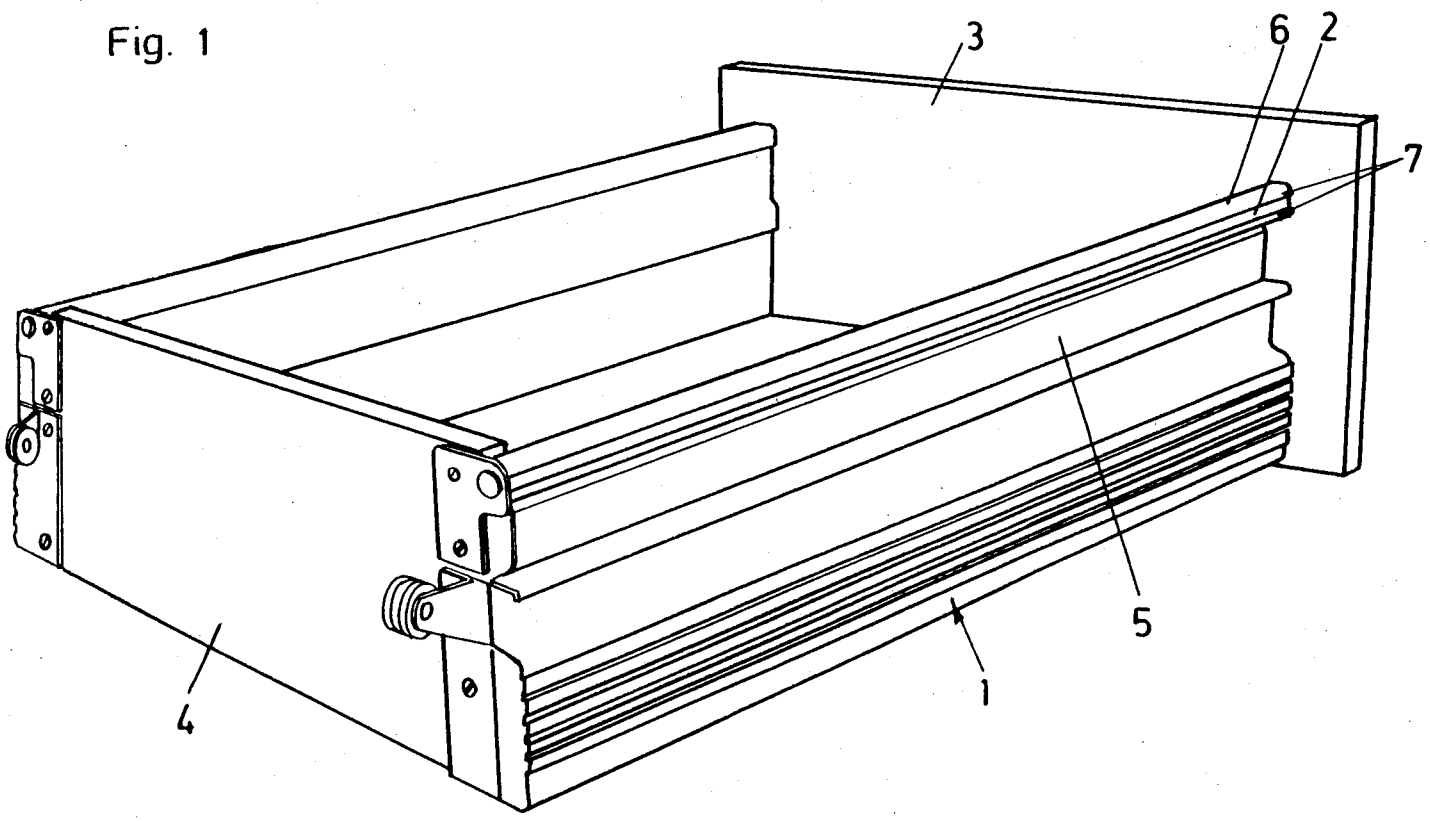
FIG. 1 is a perspective view of an embodiment of a drawer according to the invention.
Figure 2:
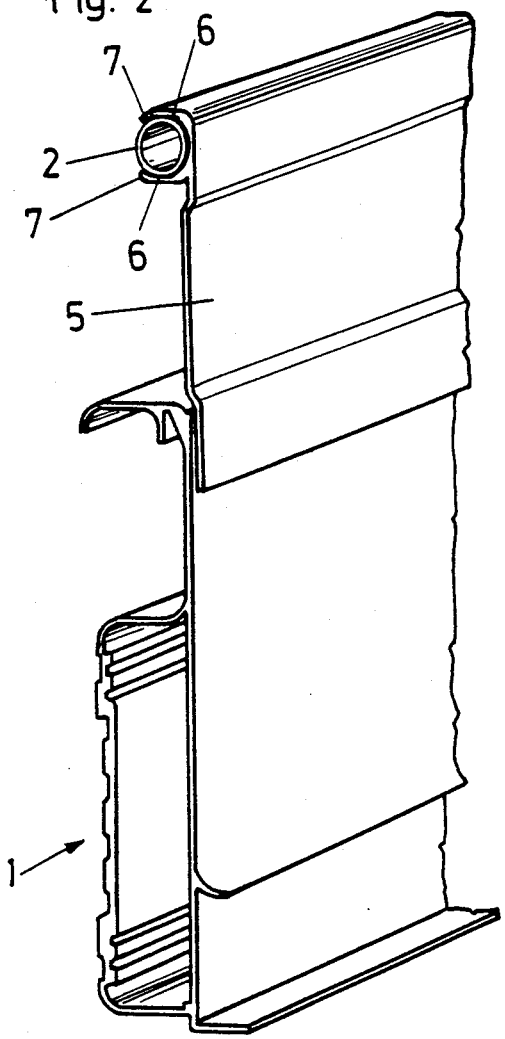
FIG. 2 is a cross sectional perspective view of a drawer side wall thereof.
Figure 3:
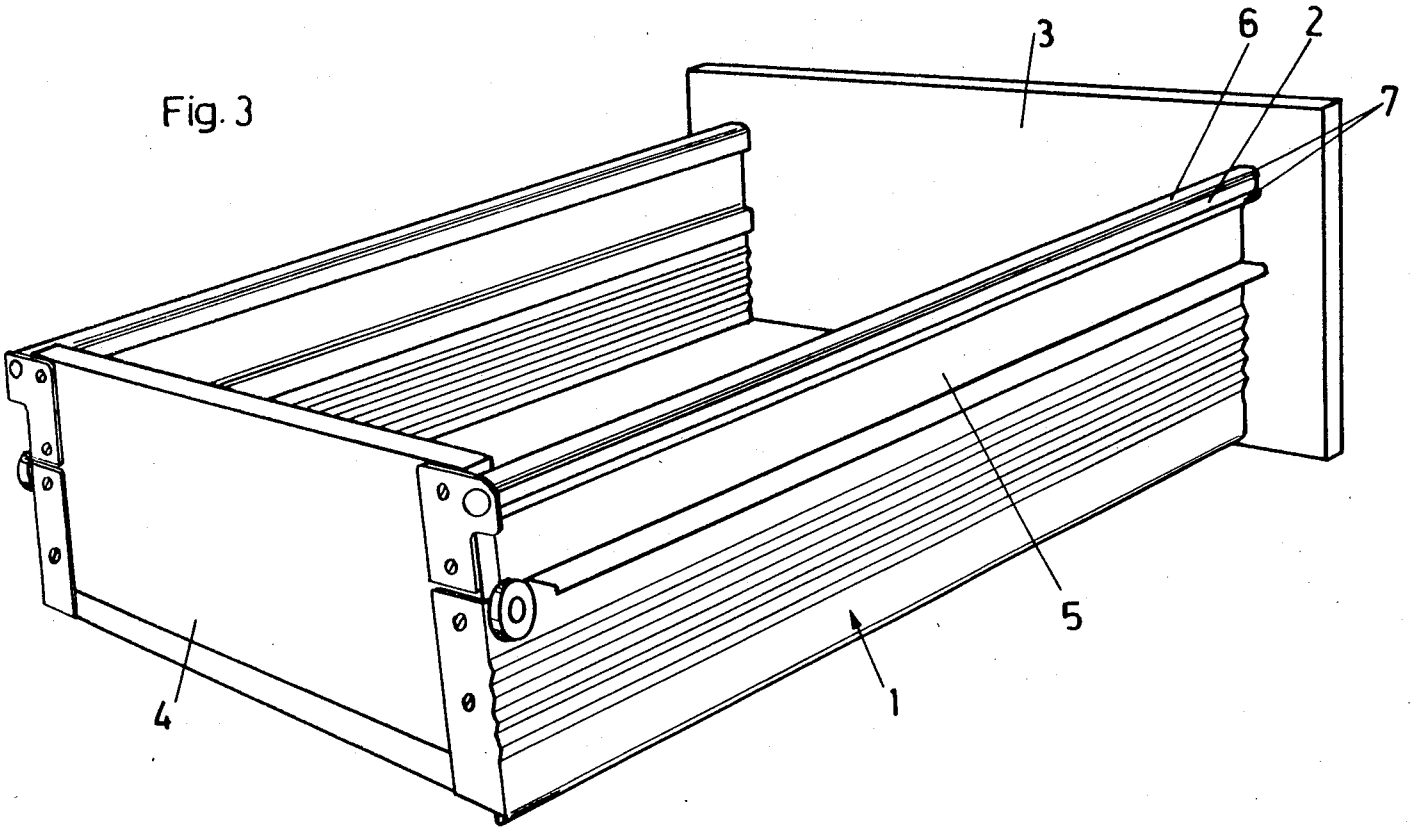
FIG. 3 is a perspective view of a second embodiment of a drawer according to the invention.
Figure 4:
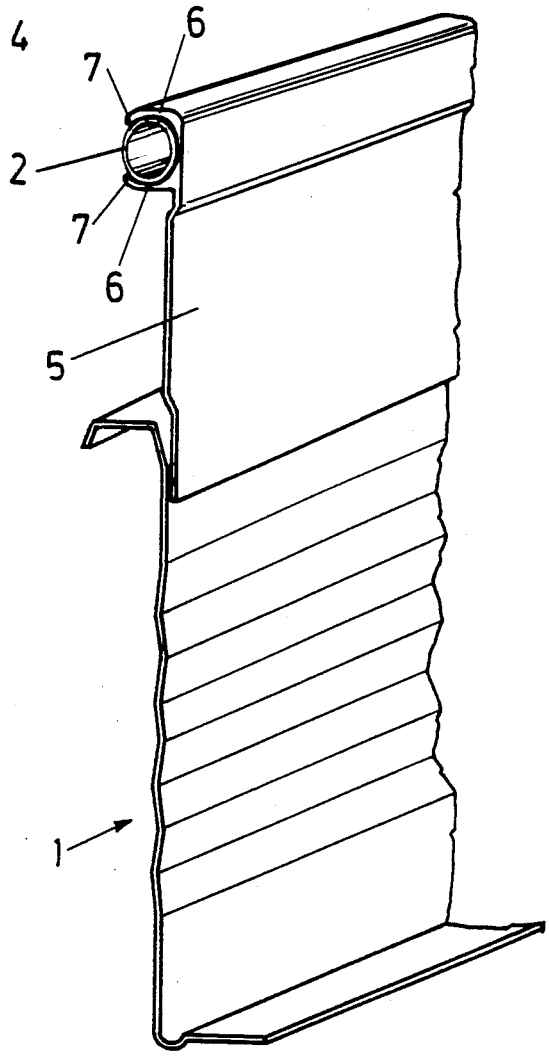
FIG. 4 is a cross sectional perspective view of a drawer side wall of the second embodiment.
Figure 5:
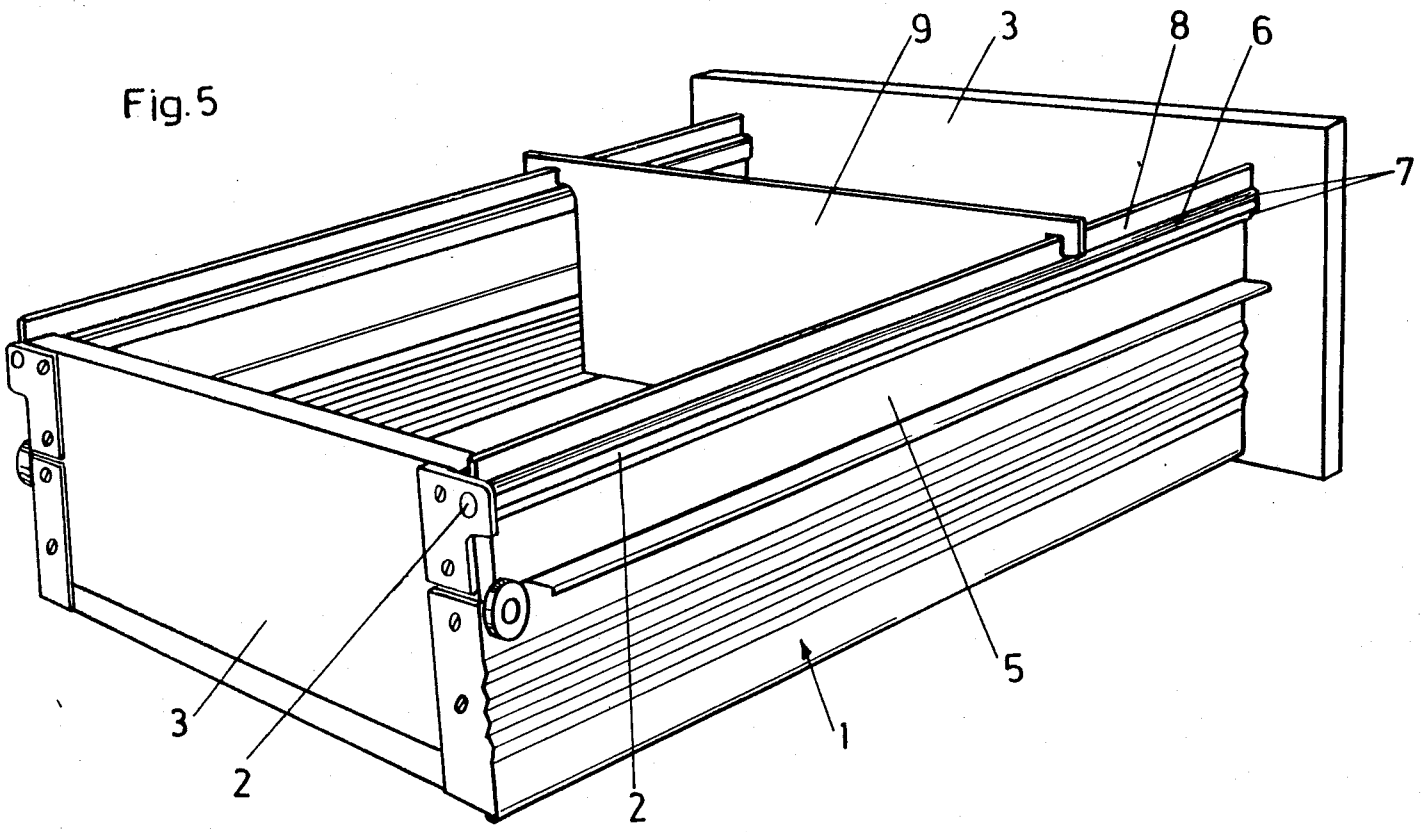
FIG. 5 is a perspective view of a further embodiment of the drawer according to the invention.

The embodiments according to FIGS. 1, 2 and according to FIGS. 3 to 5 differ from one other in that the drawer side wall 1 is double-walled in the embodiment according to FIGS. 1 and 2, while only singlewalled in the two embodiments according to FIGS. 3 to 5. In the embodiment according to FIGS. 1 and 2, the drawer side wall 1 is of extruded or moulded aluminum, while the embodiments according to FIGS. 3 to 5 include drawer side walls 1 of sheet steel.

A rail member 2 which connects a front plate 3 of the drawer with a rear wall 4 thereof is provided above each drawer side wall 1.

A top member 5 according to the invention is clamped onto each rail member 2. The top member 5 abuts on the internal side of the drawer side wall 1 and can easily be clamped onto the rail member 2 and removed therefrom.

To improve the fit of the top member 5 on the rail member 2, the top member 5 is provided with two horizontal flanges 6 with edges 7 which are angled towards each other, the flanges 6 embracing the rail member 2 in a clamping arrangement.

In the embodiment according to FIG. 5, each top member 5 is provided with an upwardly extending flange 8. In the illustrated embodiment, the flanges 8 are used for engaging a suspendable file 9. The flanges 8 may also be used for engaging separating walls for the drawer as well as applying file tabs, indices, etc.

What is claimed is:

1. In a drawer including drawer side walls extending between front and rear walls, and rail members mounted spaced above respective said side walls, the improvement comprising means, removably mounted on each said rail member, for temporarily increasing the height of the respective said side wall, said means comprising:

a top member removably connectable to said rail member to extend downwardly therefrom to a position in abutment with an inner surface of an upper end of said side wall without attachment thereto.

2. The improvement claimed in claim 1, wherein said top member is clampable onto said rail member.

3. The improvement claimed in claim 1, wherein said top member is hangable on said rail member.

4. The improvement claimed in claim 1, wherein said top member has extending therefrom two horizontal flanges with outer edge portions bent toward each other, said rail member being clampable between said two flanges.

5. The improvement claimed in claim 1, wherein said top member has a flange extending upwardly therefrom.

6. An apparatus, for use on each of opposite sides of a drawer of the type including drawer side walls extending between front and rear walls and rail members mounted spaced above respective of the side walls, for temporarily increasing the height of the respective side wall, said apparatus comprising:

a top member including means for removable connection to the respective rail member, said top member having a height to extend downwardly from the rail member to an upper end of the respective side wall, said means comprising two horizontal flanges with outer edge portions bent toward each other, with the rail member being clampable between said two flanges.

7. An apparatus as claimed in claim 6, wherein said top member has a height to extend downwardly to a position to abut with an inner surface of the upper end of the side wall without attachment thereto.

8. An apparatus as claimed in claim 6, wherein said top member has a flange extending upwardly therefrom.

9. In a drawer including drawer side walls extending between front and rear walls, and rail members mounted spaced above respective said side walls, the improvement comprising means, removably mounted on each said rail member, for temporarily increasing the height of the respective said side wall, said means comprising:

a top member removably connectable to said rail member to extend downwardly therefrom to an upper end of said side wall, said top member having extending therefrom two horizontal flanges with outer edge portions bent toward each other, said rail member being clampable between said two flanges.

10. The improvement claimed in claim 10, wherein said top member has a flange extending upwardly therefrom.

* * * * *